US005862988A

United States Patent [19]

van der Steur

[11] Patent Number: 5,862,988

[45] Date of Patent: Jan. 26, 1999

[54] COATING APPARATUS AND SHROUD THEREOF

[76] Inventor: Gunnar van der Steur, EFC Systems, Inc., 420 S. Stokes St., Havre de Grace, Md. 21078

[21] Appl. No.: 748,654

[22] Filed: Nov. 14, 1996

Related U.S. Application Data

[60] Provisional application No. 60/017,709 May 15, 1996 and provisional application No. 60/023,967 Aug. 19, 1996.

[51] Int. Cl. [6] ..... B05B 1/28; B05B 3/10; B05B 5/04

[52] U.S. Cl. ..... 239/288.5; 239/224; 239/703

[58] Field of Search ..... 239/223, 224, 239/288, 288.3, 288.5, 700, 703

[56] References Cited

U.S. PATENT DOCUMENTS

| | | | |
|---|---|---|---|
| 4,572,437 | 2/1986 | Huber et al. | 239/223 X |
| 4,601,921 | 7/1986 | Lee | 239/293 X |
| 4,605,168 | 8/1986 | Tachi et al. | 239/223 X |
| 4,899,936 | 2/1990 | Weinstein | 239/224 |
| 5,078,321 | 1/1992 | Davis et al. | 239/224 |
| 5,100,057 | 3/1992 | Wacker et al. | 239/223 |
| 5,358,182 | 10/1994 | Cappeau et al. | 239/703 |
| 5,397,063 | 3/1995 | Weinstein | 239/703 |
| 5,704,977 | 1/1998 | Baumann et al. | 239/224 X |

*Primary Examiner*—Lesley D. Morris
*Attorney, Agent, or Firm*—Foley & Lardner

[57] ABSTRACT

A coating apparatus has a two-piece shroud connected to a manifold, a rotatable shaft extending concentrically through the manifold, and a bell-cup atomizer attached to an end of the shaft. The shroud includes an annular inner member and an annular outer member concentrically shrouded over the inner member. The inner and outer members are removably held together and either the inner or outer member is detachably connected to the manifold. The inner member is held abuttingly against the manifold and positioned substantially between the bell-cup atomizer and the manifold. Shaping air nozzles or passageways are formed between the inner and outer members at their distal ends. The passageways are defined by a plurality of grooves formed at the distal end of either the inner or outer member, or both. The grooves extend to the distal terminal edge thereof. When the outer member is separated from the inner member, the passageways are exposed.

21 Claims, 7 Drawing Sheets

COATING APPARATUS AND SHROUD THEREOF

CROSS-REFERENCE

This application claims priority to Provisional Application No. 60/017,709, filed May 15, 1996 and Provisional Application No. 60/023,967, filed Aug. 19, 1996. Each of these provisional applications is incorporated herein by reference.

BACKGROUND

One type of paint sprayers or coating devices relies on a spinning bell-cup atomizer to atomize paint or coating material. The bell-cup atomizer generally needs to be spun at a relatively high RPM, to about 40,000 RPM so that its centrifugal force can atomize the coating material into a fine mist. Air is supplied through a shroud concentrically positioned over the bell-cup atomizer, adjacent where the atomized coating material leaves the bell-cup atomizer, to direct the atomized coating material to an object to be coated. The shroud is typically connected to an injection manifold, which supplies compressed air to the shroud and the coating material to the bell-cup atomizer. In practice, the atomized coating material adheres to the shroud and clogs the air holes, necessitating frequent cleaning.

To clean the air holes of a conventional shroud, one must first remove the bell-cup atomizer from a turbine shaft, which rotates the same, to remove the shroud from the manifold. Moreover, cleaning may require probing the air holes with pins or the like, which can undesirably change or distort the hole size. The hole distortion can alter the pressure, velocity, and other characteristics of the shaping air, which can generate inconsistent air streams. If the holes are successfully cleaned, the shroud is reattached to the manifold and the bell reattached to the turbine. This process is very time consuming. Further, when removing the shroud, O-rings frequently fall off the paint injection manifold, and must be replaced. This requirement adds additional cost to the operation.

In this regard, U.S. Pat. No. 4,997,921 issued to Weinstein and 4,601,921 to Lee disclose a two-piece shroud that does not require removal of the bell-cup atomizer to clean the shroud air holes. The two-piece shroud has an annular outer ring positioned concentrically over an annular inner ring. The outer ring is separable from the inner ring so that the outer ring can be detached from the injection manifold without disturbing the bell-cup atomizer or the inner ring. The two-piece shroud, however, does not have a plurality of individual shaping air holes at its distal end. Lee provides a single annular opening at its distal end. Weinstein has air holes near its distal end, but air exits at its distal end also through a single annular opening, where the individual air streams merge and exit the shroud as a single air stream. As air does not exit from individual air holes or nozzles, the air shaping capability is reduced.

Accordingly, there is a need for a shroud that provides an effective air shaping capability and easy access to the air holes or nozzles for cleaning. The present invention meets this need.

SUMMARY

A two-piece shroud for a coating apparatus according to the invention includes a first piece defining an annular inner member and a second piece defining an annular outer member shrouded over the inner member. The inner and outer members are separable. The inner member is adapted to be positioned collinearly adjacent to an injection manifold. Either the inner member or the outer member can be adapted to attach to the manifold. The inner and outer members have distal wall portions abutting against each other. A plurality of outlet nozzles or passageways are formed between the distal wall portions. These passageways extend to a distal terminal edge of at least one of the inner and outer members. Cross-sections of the passageways become exposed when the outer member is separated from the inner member to facilitate cleaning.

More specifically, the inner member has a first abutting portion and a first annular wall portion formed at its distal end. The outer member has a second abutting portion and a second annular wall portion formed at its distal end. The second distal wall portion concentrically surrounds and abuts the first distal wall portion, and the second abutting portion abuts against the first abutting portion. These distal wall portions and the abutting portions maintain the inner member concentric with the outer member. The inner and outer members have portions spaced from each other to form a chamber extending substantially between the abutting portions and the distal wall portions. The inner member has at least one inlet passageway communicating with the chamber. At least one of the first and second distal wall portions has a plurality of spaced grooves forming a plurality of outlet nozzles or passageways communicating with the chamber and the ambient. These grooves extend to a distal terminal edge of their respective distal wall portion(s). The grooves become exposed when the outer member is separated from the inner member to facilitate cleaning.

According to the invention, the grooves can be formed on the first or the second distal wall portion, or both. The distal terminal edges of the first and second distal wall portions can also be flush. The outer wall member can extend in the axial direction, away from the distal end to concentrically surround the associated manifold, which is adapted to abut against a proximal end of the inner member.

According to the invention, the inner wall member can have a proximal wall portion at the proximal end thereof, where the proximal wall portion is adapted to be fastened to the associated manifold. The proximal wall portion can have an inlet channel adapted to communicate with an air source passing through the manifold, a plurality of inlet passageways communicating the inlet channel with the chamber, and a plurality of secondary inlet passageways adapted to communicate the inlet channel with a second chamber defined by an inner periphery of the inner wall member and an outer periphery of a bell-cup atomizer associated with the coating apparatus. The inlet channel is annular.

The inner member can be provided with at least one passageway for directing fluid, such as a cleaning solvent, to an inner periphery of the first distal wall portion, near where the distal end of the bell-cup atomizer would be situated.

The outer member can be provided with a plurality of secondary air passageways extending through the outer wall member, which passageways are adapted to bleed a portion of air to be introduced through the at least one inlet passageway into the ambient.

According to the invention, the first and second abutting portions can have complementary threads formed on an outer periphery of the inner member and an inner periphery of the outer member. The threads and the first and second distal wall portions hold the inner and outer members together and maintain the inner member concentric with the outer member. In another embodiment, the first and second abutting portions can have complementary shoulders formed on an outer periphery of the inner member and an inner periphery of the outer member, the shoulders and the first and second distal wall portions maintaining the inner member concentric with the outer member. The chamber defined between the abutting portions and the distal wall portions provides a high-volume, low-pressure (HVLP) region.

A coating apparatus according to the invention incorporates the shroud summarized above. The coating apparatus includes a manifold, a shaft, and a bell-cup atomizer. The manifold has an air passageway adapted to communicate with an air source and a coating material passageway adapted to communicate with a coating material source. The shaft is adapted to be rotatably journalled and extends concentrically through the manifold. A bell-cup atomizer is attached to an end of the shaft. The bell-cup atomizer has a plurality of outlet passageways that communicate with the coating material passageway. The inner member of the shroud is held abuttingly against the manifold and positioned substantially between the bell-cup atomizer and the manifold. The inlet passageway formed in the inner member communicates the chamber with the air passageway in the manifold. The outlet passageways formed between the distal wall portions communicate the chamber with the ambient.

According to the invention, the outer member is dimensioned to permit insertion and withdrawal of the inner member together with the bell-cup atomizer in an axial direction without any interference from the bell-cup atomizer.

BRIEF DESCRIPTION OF THE DRAWINGS

These and other features, aspects, and advantages of the present invention will become more apparent from the following description, appended claims, and accompanying exemplary embodiments shown in the drawings, which are briefly described below.

DETAILED DESCRIPTION

Figure 1:
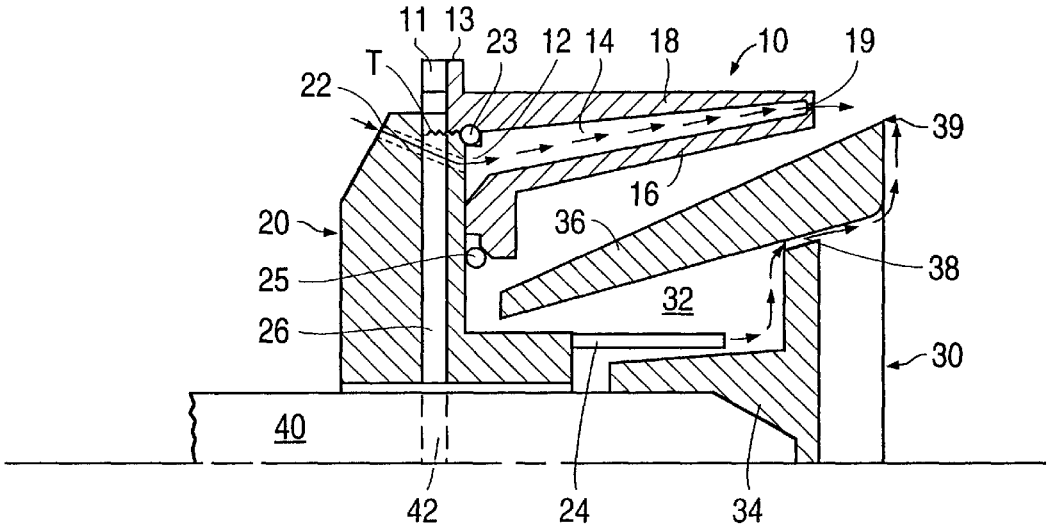
FIG. 1 (PRIOR ART)
FIG. 1 is a partial-sectional view of a conventional coating apparatus embodying a single piece shroud.
Figure 3:
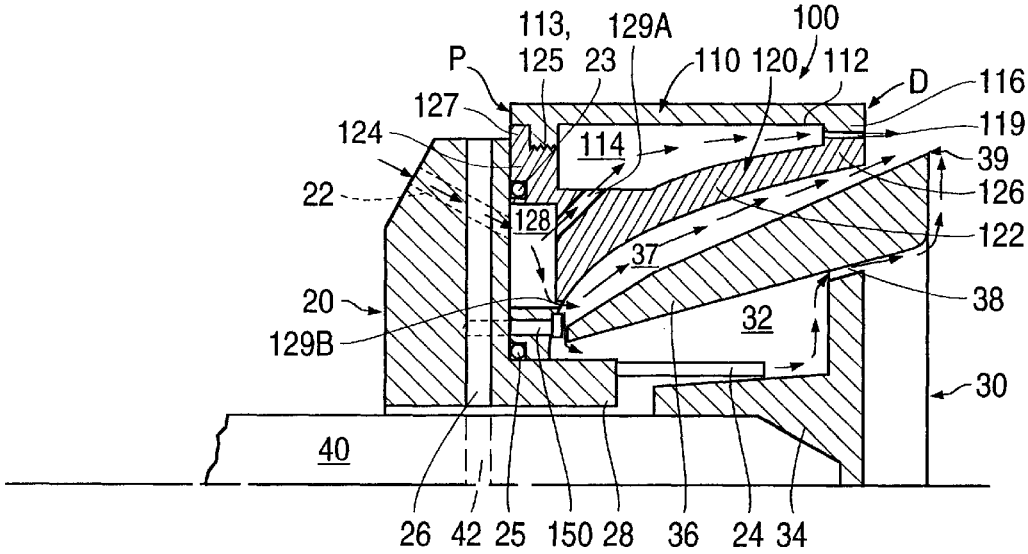
FIG. 3 is a partial-sectional view of a coating apparatus embodying a two-piece shroud according to the present invention.

FIG. 1 illustrates a conventional coating apparatus incorporating a single-piece shroud and FIGS. 2 and 2A–2C illustrate a conventional two-piece shroud. The exemplary embodiments, as shown in FIGS. 4–15, which incorporate the two-piece shroud as schematically illustrated in FIG. 3, serve to illustrate the present invention. Same or corresponding elements are labeled with the same reference designation.

FIG. 1 shows a conventional coating apparatus where an annular single-piece shroud 10 is attached to a paint injection manifold 20 using threads T. O-rings 23 and 25 are sandwiched between the manifold 20 and the shroud 10 to provide an air-tight seal therebetween. A bell-cup atomizer 30 is positioned concentric with the shroud 10 and is threadingly connected to one end of a turbine shaft 40, which spins the bell-cup atomizer 30.

Compressed air is forced through a passage 22 formed in the injection manifold 20, which in turn enters through an annular inlet 12 formed in the proximal end of the shroud 10. The shroud 10 has an annular outer wall 18 spaced from and concentrically positioned over an annular inner wall 16. The inner and outer walls 16, 18 are integral at the distal end. The space 14 formed between the inner and outer walls serves as a passageway for communicating air to a plurality of axially extending air holes 19 circumferentially spaced around the annular distal end of the shroud 10.

A paint or coating material is supplied through a paint supply passageway (not shown) in the manifold and exited through a valve 24 communicating with the paint supply passageway. The coating material travels through a chamber 32 formed between the atomizer's annular inner and outer walls 34, 36 and passes through a plurality of circumferentially spaced openings 38 formed near the distal end. The outer wall 36 is spaced from and concentrically surrounds or shrouds the inner wall 34. Due to the centrifugal force generated by the spinning bell-cup atomizer 30, the coating material travels radially outwardly as indicated by the arrows and becomes atomized as it is rapidly thrown from a distal edge 39 of the bell-cup atomizer 30. Air exiting through the air passageways 19 intercepts and directs the atomized coating material so that it travels toward the product to be coated.

To clean the air passageways 14, which frequently become clogged from the coating material, the shroud 10 must be detached from the manifold 20 so that the air inlet 12 becomes accessible. To do that, the bell-cup atomizer 30 must be first removed from the shaft 40. Since the shaft 40 is rotatable, it must be locked from rotation. For this purpose, a radially-extending locking through-hole 42 is provided in the shaft 40. The hole 42 is alignable with a radially-extending through-hole 26 in the manifold 20 and a radial slot 11 formed in a flange 13 of the shroud 10.

In operation, to remove the atomizer 30 from the shaft 40, the shroud 10 is rotated (loosened) from the manifold 20 to align the slot 11 with the hole 26 in the manifold 20 to allow insertion of a locking pin (not shown). The shaft 40 is rotated to align its hole 42 with the pin to allow insertion of the pin therein, whereupon the shaft 40 becomes locked in place (prevented from rotation). The bell-cup atomizer 30 is then taken off the shaft 40 (by unscrewing). The shroud 10 can then be detached from the manifold 20 by unscrewing. Once the shroud 10 is removed from the assembly, the air inlet 12 is accessible to enable cleaning and removal of any accumulated debris clogging the holes 19. After the cleaning process is complete, reassembly of the system requires the O-rings 23 and 25, positioned in their appropriate locations, to form an air-tight seal after the shroud 10 is threaded to the manifold 20. Then, the bell-cup atomizer 30 is reattached to the turbine shaft 40 and the locking pin taken out. This cleaning process is time consuming and cumbersome.

Figure 2B:
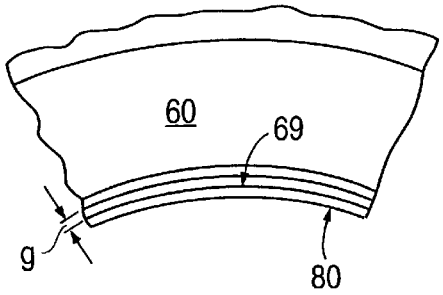
FIG. 2B (PRIOR ART)
FIG. 2B is a front view of FIG. 2 taken along line 2B—2B of FIG. 2.
Figure 2C:
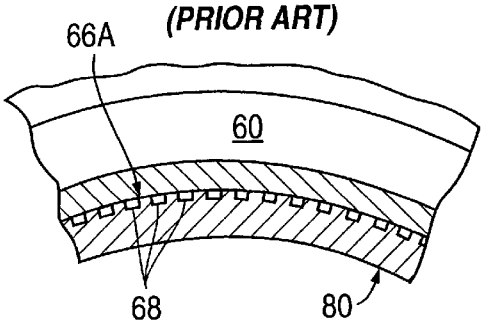
FIG. 2C (PRIOR ART)
FIG. 2C is a cross-sectional view of FIG. 2 taken along line 2C—2C of FIG. 2.
Figure 2:
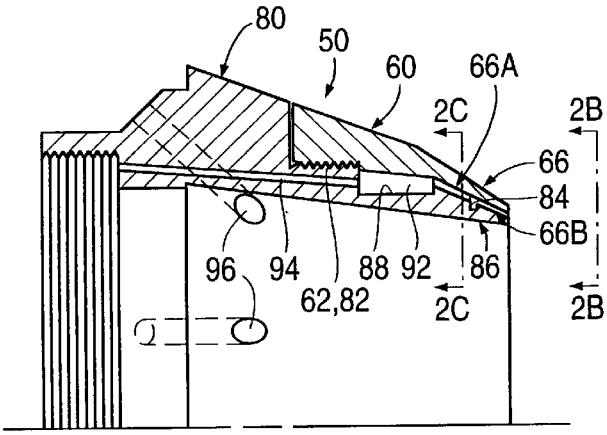
FIG. 2 (PRIOR ART)
FIG. 2 is a partial-sectional view of a conventional two-piece shroud.
Figure 2A:
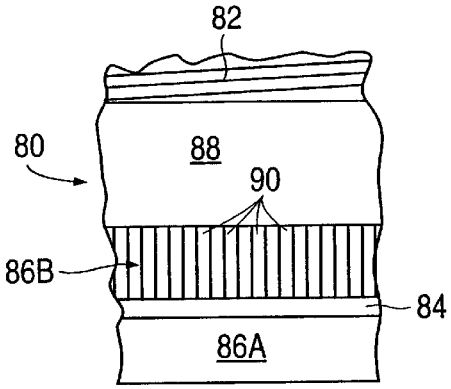
FIG. 2A (PRIOR ART)
FIG. 2A is a partial-sectional view of an inner shroud member of FIG. 2, showing the exposed grooves that form the shaping air passageways.

FIG. 2 shows a conventional two-piece shroud 50 adapted to connect to a paint injection manifold (not shown), as similarly disclosed in U.S. Pat. No. 4,997,130. This two-piece shroud 50 comprises an annular outer shroud ring 60 concentrically shrouding around or surrounding an annular inner shroud ring 80. The inner and outer shroud rings 80, 60 are detachably connected to each other using threads 62, 82. The inner shroud ring 80 has threads 82 at its outer periphery about its axial mid-section and a distal wall section 86 having a smooth outer peripheral band portion 86A extending to its distal edge and an embossed band portion 86B extending substantially radially outwardly and extending axially away from the outer peripheral band portion 86A toward the threads 82. Between the embossed band portion 86B and the smooth band portion 86A is an annular groove 84. See FIG. 2A. The embossed band portion 86B has a plurality of evenly spaced apart grooves 90 around its circumferential periphery. An annular channel 88 is formed between the threads 82 and the distal wall section 86, which channel together with the inner periphery of the outer shroud ring 60 forms an annular passageway 92. The inner shroud ring 80 also has a plurality of air passageways 94 communicating with the passageway 92. A plurality of secondary air passageways 96, which direct air to an outer periphery of the bell-cup atomizer (not shown), are also provided.

The annular outer shroud ring 60 concentrically shrouds over a portion of the inner shroud ring 80 when connected together. Threads 62 are formed at its inner periphery of the proximal end portion, which mate with the outer-shroud ring threads 82. The outer shroud ring 60 has a smooth distal wall section 66 having a portion 66B that abuts against the outer periphery of the embossed band portion 86B to form a plurality of shaping air passageways 68 together with the grooves 90. The distal wall section 66 further has a portion 66A that is radially spaced from and opposing the smooth outer peripheral band portion 86A to form an annular, ring-shaped air outlet 69. A small air gap "g" formed between the outer and inner shroud members 60, 80 at their distal ends allows air steams passing through the passageways 68 to merge and exit through the ring-shaped outlet 69. When the outer shroud member 60 is separated from the inner shroud member 80, the grooves 90 and the inner and outer peripheral surfaces of the inner and outer rings become exposed to facilitate cleaning.

In the embodiment of FIG. 2, the passageways 68 do not terminate at the distal end or edge. The air streams flowing through the passageways 68 do not exit but merge in the ring-shaped outlet 69 before exiting the shroud. Because the air has to travel through the ring-shaped chamber, the air shaping capability is reduced.

Figures 4, 6:
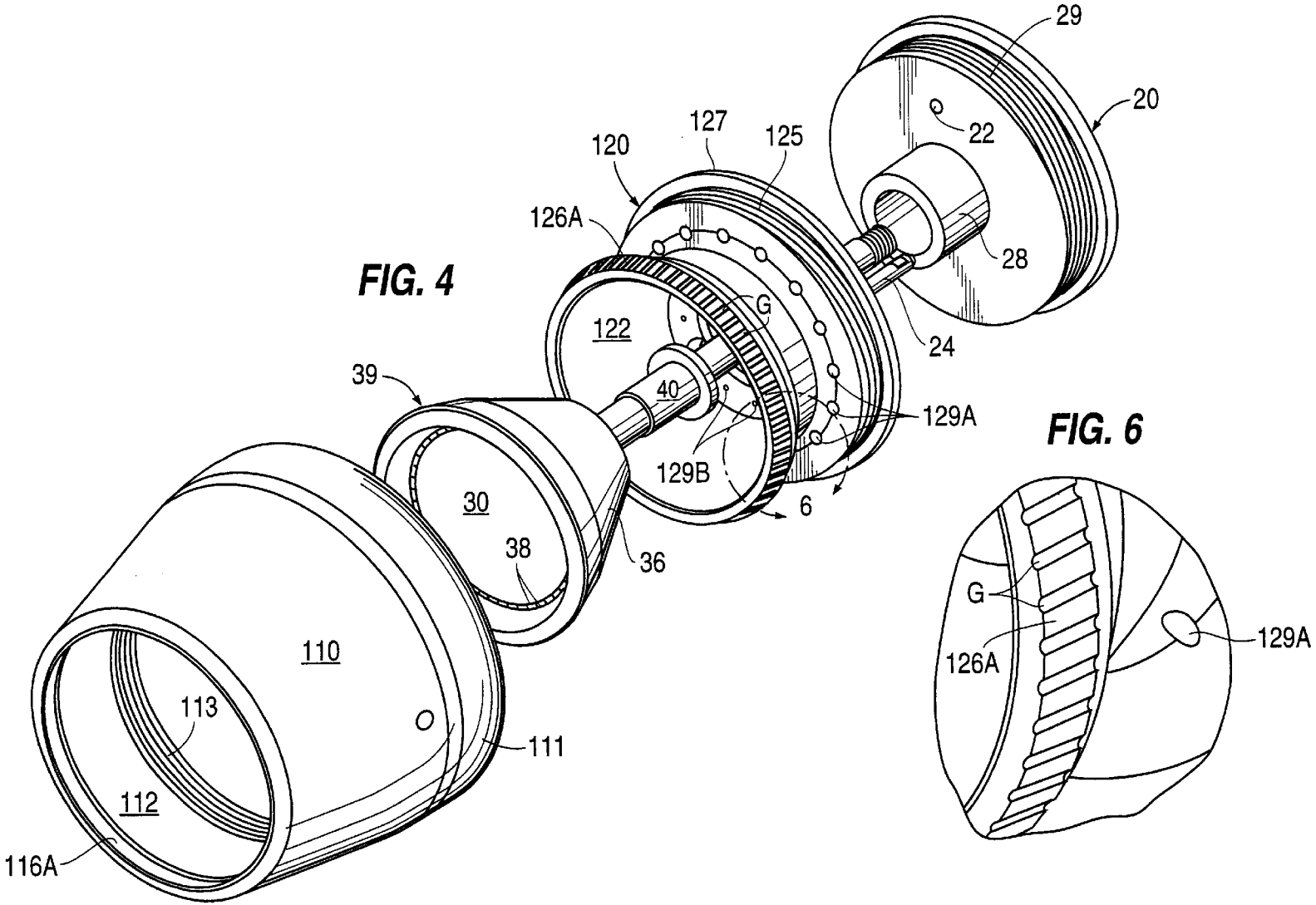
FIG. 4 is an exploded perspective view of a another embodiment of a coating apparatus according to the present invention embodying a two-piece shroud similar to that of FIG. 3.
FIG. 6 is a magnified view of a circled portion of FIG. 4 showing the grooves, which form outlet passageways or nozzles, at the outer peripheral distal end of the inner shroud member.
Figure 5:
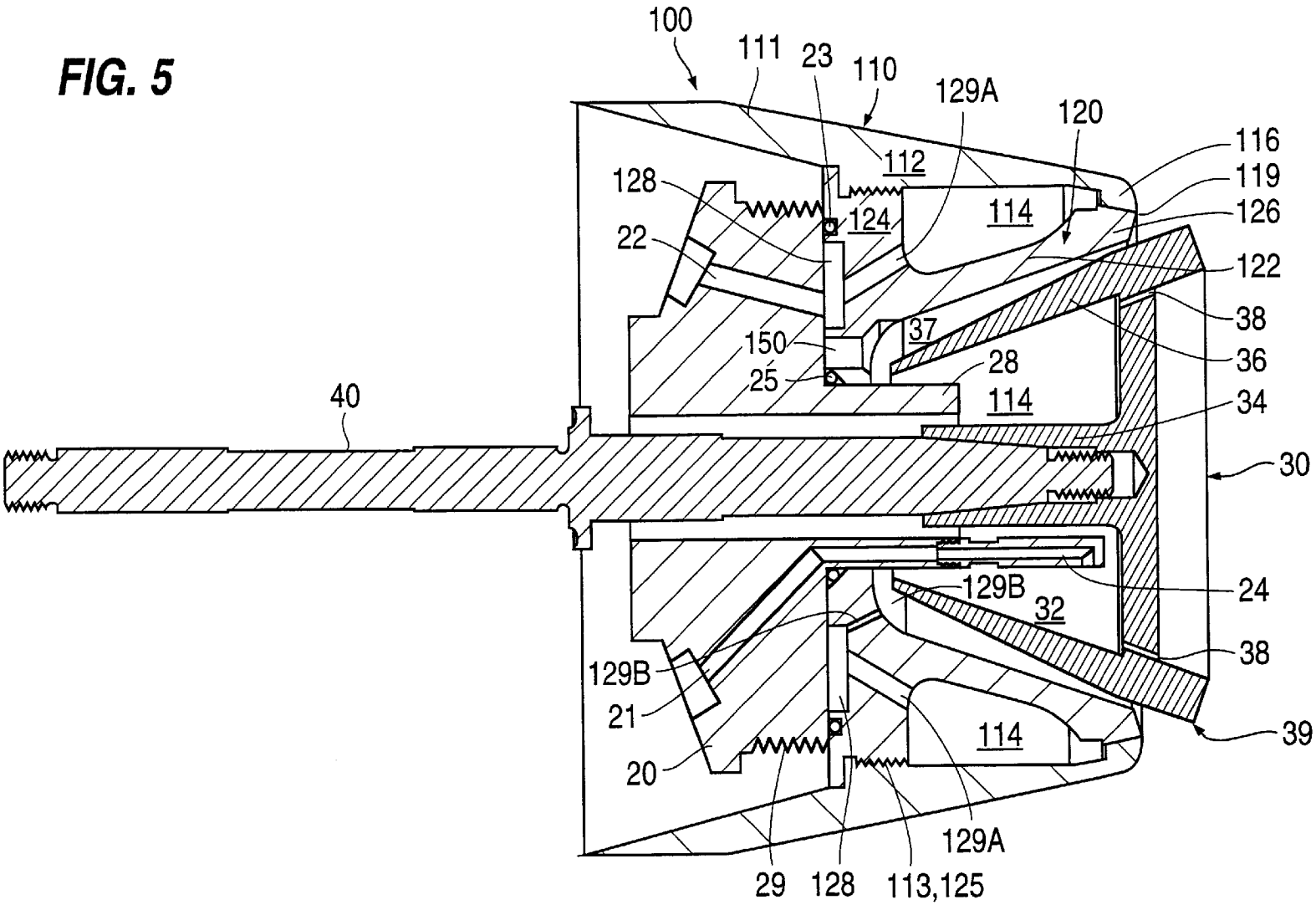
FIG. 5 is a sectional view of the assembled coating apparatus shown in FIG. 4.

FIGS. 3–6 illustrate one embodiment of a two-piece shroud 100 according to the present invention, which overcomes the noted drawbacks of the conventional one-piece and two-piece shrouds. FIG. 3 schematically illustrates the shroud. FIG. 5 is a cross-section of an assembled version of the apparatus shown in FIG. 4, which is a variation of the two-piece shroud shown in FIG. 3.

In this application the terms "proximal" and "distal" are used to describe relative locations. As viewed from FIG. 3, the proximal end is the upstream end (relative to the air flow) generally indicated by "P" and the distal end is the downstream end generally indicated by "D".

The present two-piece shroud 100 comprises an annular outer shroud ring or member 110 shrouding around or surrounding an inner shroud ring or member 120. The outer and inner shroud members 110, 120 can be detachably connected to each other using conventional fasteners, such as complementary threadings (as shown), bayonet mounts, snap-fittings, latches, etc. The inner shroud member 120 can be fixedly connected to the manifold 20 because it need not be detached from the manifold 20 to clean the shroud 100. In this regard, screws 150 (shown in FIG. 3) can be used to attach the inner shroud member 120 to the manifold 20. The inner shroud member 120 has an annular inner wall member or body 122, a substantially disk-shaped annular proximal wall or base portion 124 formed at the proximal end, and an annular distal wall portion 126 formed at the distal end of the inner body 122.

The proximal base portion 124 abuts against and is secured to the manifold 20 with a plurality of screws 150, as explained before. Three or more screws, evenly placed, can be used to connect the inner member 120 to the manifold 20. A pair of O-rings 23 and 25 are used to provide an air-tight seal between the manifold and the base portion 124. The base portion 124 has a central through-hole (not numbered) to permit insertion of a cylindrical member 28 extending axially from the manifold 20, as well as to permit passage of the shaft 40 without any interference. The outer periphery of the base portion 124 has a flange 127 and threads 125 for detachably mating with complementary threads 113 of the outer shroud member 110.

The proximal base portion 124 includes an annular channel 128 communicating with the air passageway 22 in the manifold 20. According to the invention, the channel 128 has two sets of radially spaced air passageways 129A, B. The first set of primary passageways 129A, which are formed circumferentially around the annular base portion 124, communicate with a high-volume, low-pressure (HVLP) chamber 114 formed between the radially spaced area of the annular outer and inner shroud members 110 and 120. The second set of secondary air passageways 129B, which are also formed circumferentially around the annular base portion 124, communicate with a passageway 37 formed between the inner shroud member 120 and the bell-cup outer wall 36. As more clearly shown in FIG. 5, the opening size of the cleaning passageways 129B is substantially smaller than that of the primary passageways 129A so that only a small amount of air is bled to the cleaning passageways 129B. Whereas, the prior two-piece shroud of FIG. 2 requires a separate air source connected to its cleaning passageways 96, according to the present invention, the same air source that delivers the shaping air is shared with the air passing through the secondary passageways 129B, simplifying the assembly.

A paint or coating material is supplied through a paint supply passageway 21 (FIG. 5) in the manifold 20 and exited through a valve 24 communicating with the paint supply passageway 21, which is formed axially through the cylindrical member 28. The coating material travels through a chamber 32 formed between the atomizer's annular inner and outer walls 34, 36 and passes through a plurality of circumferentially spaced openings 38 formed near the atomizer's distal end.

The distal wall portion 126 has an annular outer peripheral surface 126A that can have a plurality of substantially axially extending grooves G spaced circumferentially thereafter as will be described in detail below with reference to FIGS. 6, 9, and 11–15.

The outer shroud member 110 has an annular outer wall member or body 112, with the threads 113 formed at the internal periphery of the proximal end (FIG. 3), and an annular distal wall portion 116 formed at the distal end of the outer body 112. The outer shroud member 110 concentrically shrouds or surrounds over the inner shroud member when they are connected. The outer body 112 is radially spaced from the inner body 122 to form the HVLP chamber 114. The outer shroud member 110 can have an extension 111, as shown in FIG. 5, extending axially in the proximal direction to cover the manifold 20 and related connections. This helps to keep the coating material away from these components.

The distal wall portion 116 has an annular inner peripheral surface 116A that can have a plurality of axially extending grooves G spaced circumferentially as will be described in detail below with reference to FIGS. 6, 9, and 11–15. The inner peripheral surface 126A and the outer peripheral surface 116A abut each other to form a seal when the outer shroud member is connected to the inner shroud member. That is, the outer peripheral surface 116A surrounds and abuts against the inner peripheral surface 126A when assembled. The grooves G can be formed either on the inner or outer peripheral surface 116A, 126A. The grooves G along with the abutting peripheral surface form a plurality of substantially axially extending air passageways or nozzles 119. When the outer shroud member 110 is separated from the inner shroud member 120, the grooves and the surface 116A, 126A become exposed to facilitate cleaning. Thus, to clean the air passageways 119, one merely needs to remove the outer shroud member 110 from the inner shroud member 120 to expose the grooves G. There is no need to take the bell-cup atomizer 30 off, saving time and cost. As will be further discussed below, the air passages are formed by slots or grooves G in the inner shroud, the outer shroud, or both (in non-threaded connection). For convenience, the inner and outer shroud members 120, 110 are connected by a threaded engagement where the outer shroud member 110 is unscrewed from inner shroud member 120 to separate them. Other engagements may also be employed to connect the inner and outer shroud members, such as a bayonet mount, snap fitting, frictional, etc.

In operation, air is supplied through the proximal end of the shroud 100 via the manifold 20 and the inlet passageway 22, the channel 128, and the passageways 129A, and to the HVLP chamber 114. Air in the HVLP chamber exits through the passageways 119 at the distal end of the shroud 100. A small portion of air is deliberately bled through the cleaning air passageways 129B, which places positive air pressure to prevent the coating material from entering into the passageway 37 formed between the outer periphery of the bell-cup atomizer 30 and the inner periphery of the inner shroud member 120. The air traveling through the passageway 37 also helps to clean the surfaces defining the passageway 37, and hence improve the longevity of the bell-cup atomizer (i.e., by preventing out of balance problems associated with debris accumulation).

FIG. 6 shows a magnified view of the grooves G formed on the outer periphery of the distal end of the inner shroud member, which grooves form air shaping passageways or nozzles 119 when the outer and inner shroud members 110 and 120 are connected.

Figure 7:
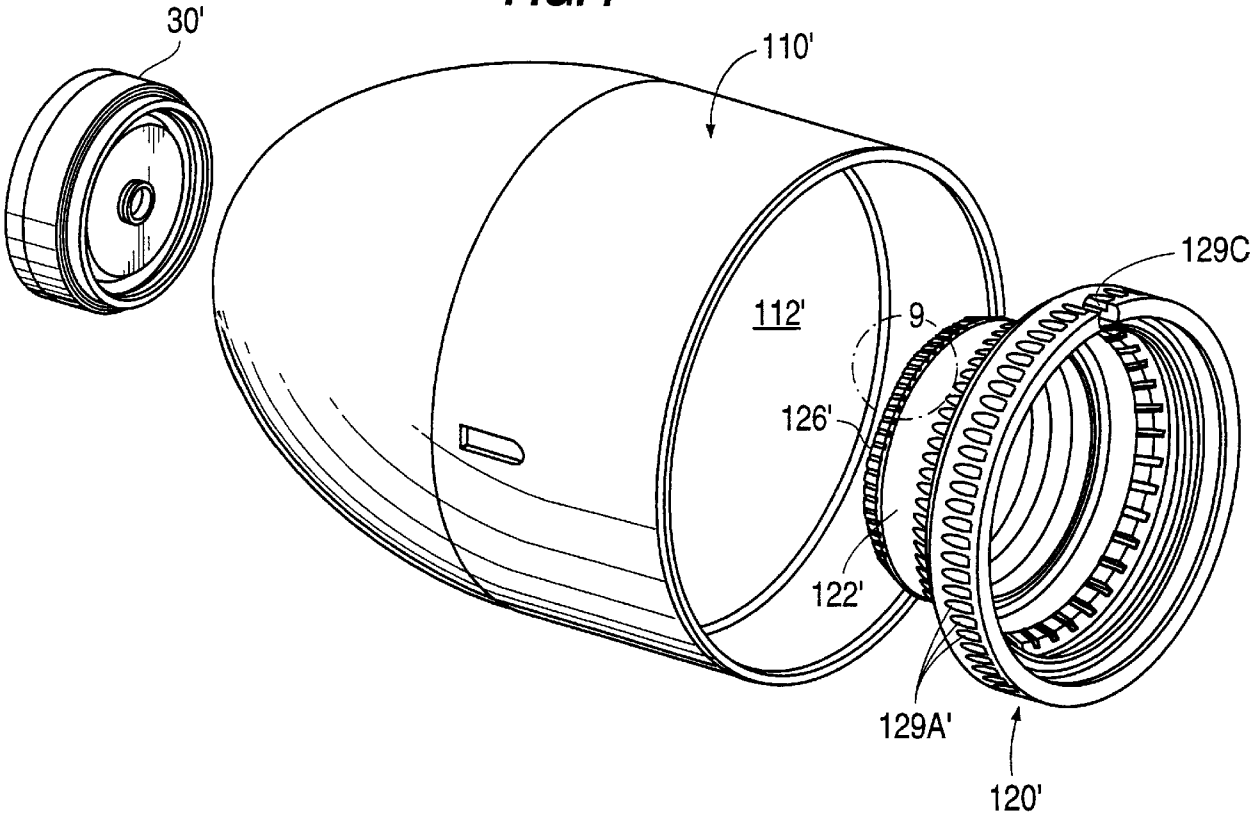
FIG. 7 is an exploded view of another embodiment of a coating apparatus according to the present invention embodying a two-piece shroud similar to that of FIG. 4.
Figure 10:
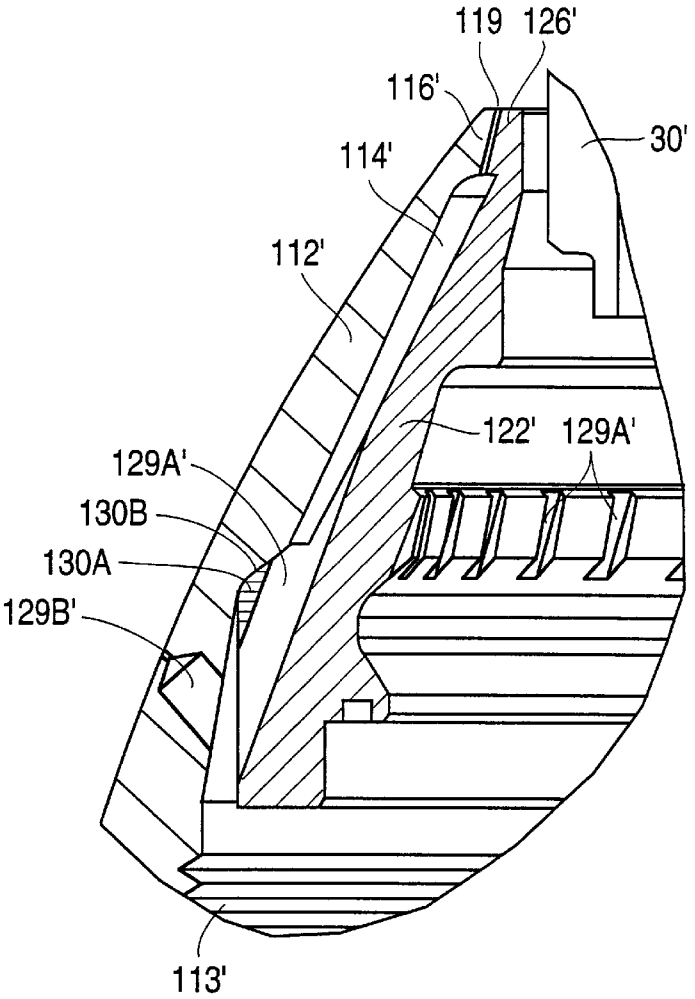
FIG. 10 is a magnified view of a circled portion of FIG. 8 showing the cross-section of the inner and outer shroud members.
Figure 8:
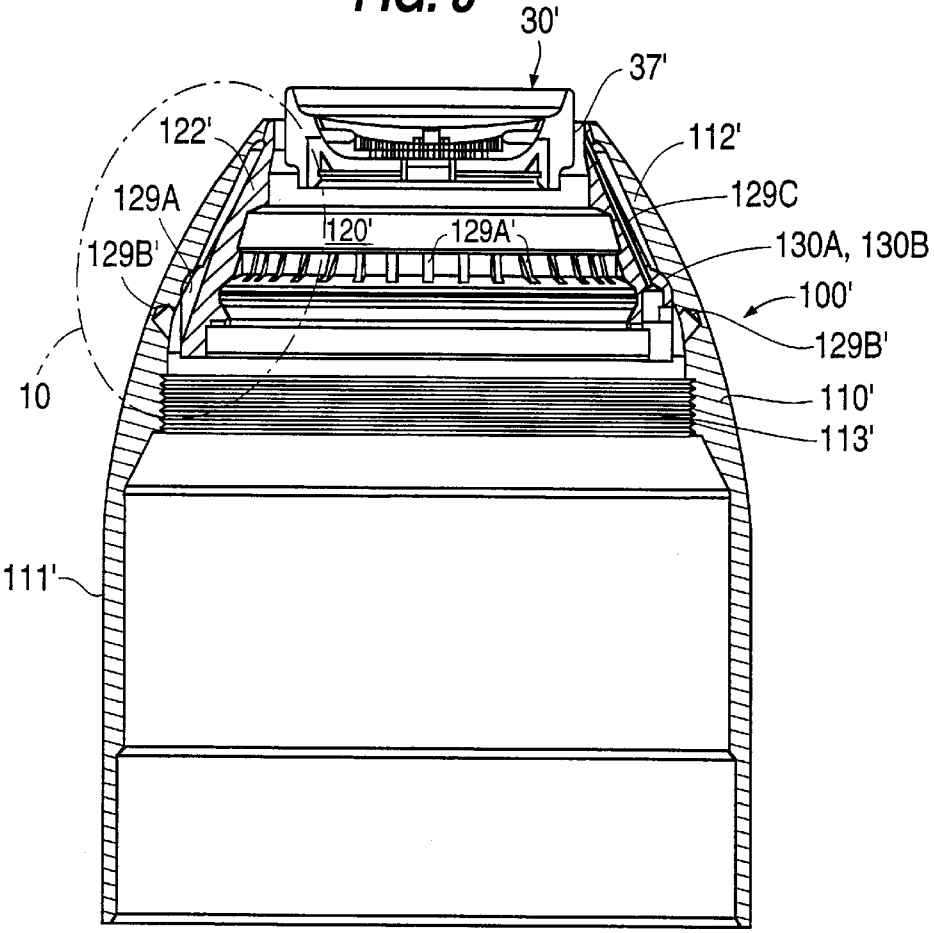
FIG. 8 is a sectional view of the assembled apparatus shown in FIG. 7.

FIGS. 7–10 show another embodiment of the coating apparatus according to the invention, also utilizing a two-piece shroud 100'. FIG. 8 shows a cross-section of an assembled version of the apparatus shown in FIG. 7. The shroud 100' according to this embodiment comprises an annular ring or housing-like shroud member 110', which concentrically surrounds an annular inner shroud member 120'.

The inner shroud member 120' has an annular inner wall member or body 122' and an annular distal wall portion 126' formed at the distal end of the inner body 122. A plurality of primary passageways 129A' are formed circumferentially around near the proximal end of the inner wall member 122', which passageways 129A' communicate with a chamber 114' formed between the radially spaced area of the annular outer and inner shroud members 110' and 120'.

As shown in FIGS. 7 and 8, the inner member 120' can be provided with a passageway 129C that extends substantially its entire axial length, from its proximal end to near its distal end. This passageway 129C does not communicate with the chamber 114'. Rather, this passageway 129C communicates with a chamber 37' defined by the outer periphery of the bell-cup atomizer 30' and the inner periphery of the inner member 120'. A cleaning agent, such as a paint solvent, can be introduced through the passageway 129C. The cleaning agent cleans any coating material remaining on the outer periphery of the bell-cup atomizer 30'. Although only one cleaning passageway 129C is provided in this embodiment, more than one can be provided. Another passageway 129C may be included to introduce different cleaning liquid, such as water.

Adjacent to the inlet side of the passageways 129A, where air source from the manifold introduces compressed air, there is a plurality of secondary passageways 129B' extending through the outer member 110'. As more clearly shown in FIG. 10, the exit opening of the passageways 129B' is relatively small compared to the opening size of the primary passageways 129A' so that only a relatively small portion of the supply air bleeds out through the outer member 110'. The secondary air passageways 129B' are angled generally upwardly to direct air outwardly and axially toward its distal end. This helps to keep atomized coating material away from the outer member 110'.

The distal wall portion 126' has an annular outer peripheral surface 126A' that can have a plurality of substantially axially extending grooves G spaced circumferentially thereabout as will be described in detail below with reference to FIGS. 6, 9 and 11–15. The inner member 120' further has an annular shoulder 130A, which protrudes substantially radially.

The outer shroud member 110' has an annular outer wall member or body 112', with threads 113' formed at the internal periphery and an annular distal wall portion 116'. Similar to the embodiment shown in FIG. 5, the outer wall member 112' extends beyond the proximal end of the inner wall member 122' to keep the components of the coating apparatus shielded against the atomized coating material.

The distal wall portion 116' has an annular inner peripheral surface 116A that can have a plurality of axially extending grooves G spaced circumferentially as will be described in detail below with reference to FIGS. 6, 9, and 11–15. The inner peripheral surface 126A' and the outer peripheral surface 116A' abut each other to form a seal when the inner shroud member 120' is seated in the outer shroud member 110'. That is, the outer peripheral surface 116A' surrounds and abuts against the inner peripheral surface 126A' when assembled. The grooves G can be formed either on the inner or outer peripheral surface 116A', 126A'. The grooves G, along with the respective abutting peripheral surface, form a plurality of substantially axially extending air nozzles or passageways 119'.

The inner peripheral surface of the outer member 110' has an annular shoulder 130B configured complementary with the annular shoulder 130A of the inner member 120'. These annular shoulders 130A, 130B abut against each other when the inner member 120' is seated in the outer member 110'. These shoulders 130A, 130B and the distal wall portions 116', 126' maintain the inner member 120' concentric with the outer member 110'. Between these abutting surfaces 130A, 130B and 116', 126', the outer body 112' is radially spaced from the inner body 122' to form the annular chamber 114', which can be a HVLP region. The inner member 120' is held in place with the outer member 110' with a retainer ring or the manifold 20 (not shown in FIGS. 7–10) screwed to the threads 113' formed in the inner periphery of the outer member 110' using threads 29 (FIG. 5) formed on the outer periphery of the manifold 20.

In the embodiment of FIGS. 3–6, the manifold is attached to the inner member 120. In the embodiment of FIGS. 7–10, the manifold is attached to the outer member. To access the grooves G, in the second embodiment, the outer shroud member 110' is unscrewed from the manifold 20, which permits separation of the outer shroud member 110' from the inner shroud member 120'. The inner member 120' is held together as a unit with the bell-cup atomizer 30', which is attached to the turbine shaft 40, and the manifold 20. There is no need to take off the bell-cup atomizer 30' to clean the shaping air passageways 119, saving time and cost. As will be further discussed below, the air passages are formed by slots or grooves G in the inner or the outer shroud member, or both (in non-threaded connection).

Figure 9:
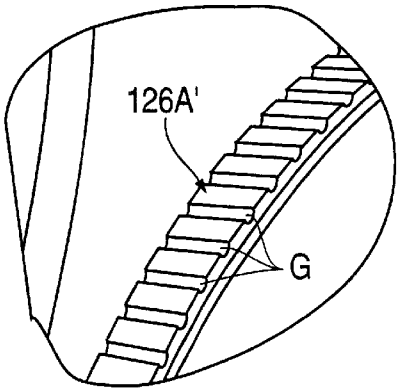
FIG. 9 is a magnified view of a circled portion of FIG. 7 showing the grooves formed at the outer peripheral distal end of the inner shroud member.

FIG. 9 shows a magnified view of the grooves G formed on the outer periphery of the distal end portion 126' of the inner shroud member 120', which grooves form the air shaping passageways 119 when the outer and inner shroud members 110' and 120 are assembled. As with the other embodiments, the grooves extend to the distal edge of the shroud member 120'.

Figure 11:
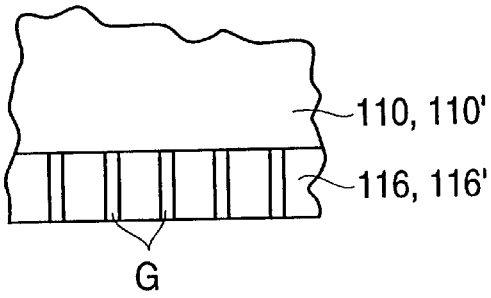
FIG. 11 is a two-dimensional view showing another embodiment of the grooves, which is similar to the embodiment shown in FIGS. 6 and 9, but with the grooves formed at the inner peripheral end of the outer shroud member.
Figure 12:
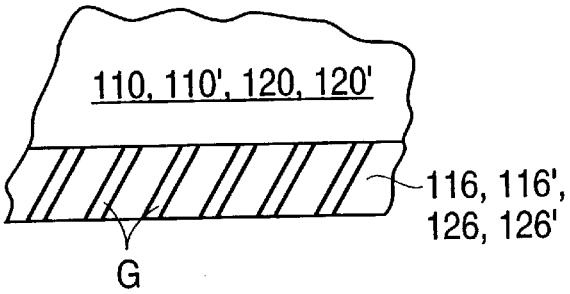
FIG. 12 is a two-dimensional view similar to FIG. 11, showing yet another embodiment of the grooves, which are angled relative to the axial direction of the shroud and formed at either the inner peripheral distal end of the outer shroud member or the outer peripheral distal end of the inner shroud member.
Figure 13:
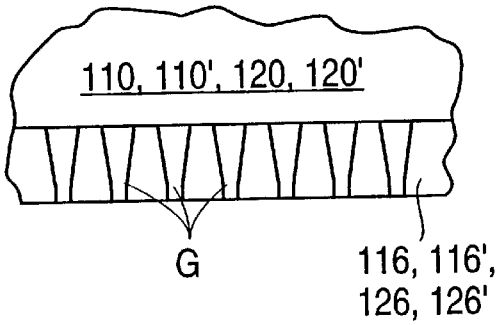
FIG. 13 is a two-dimensional view similar to FIG. 11, showing yet another embodiment of the grooves, which are substantially V- or funnel-shaped and formed at either the inner peripheral distal end of the outer shroud member or the outer peripheral distal end of the inner shroud member.
Figure 14:
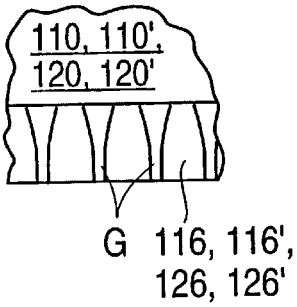
FIG. 14 is a two-dimensional view similar to FIG. 13, showing a variation thereof, in which the V-shaped grooves have curved contours formed at either the inner peripheral distal end of the outer shroud member or the outer peripheral distal end of the inner shroud member.
Figure 15:
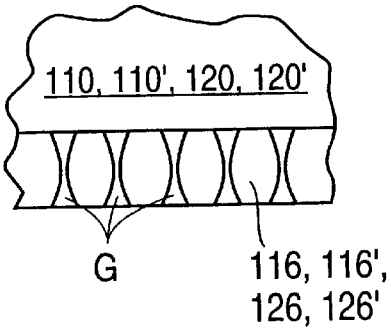
FIG. 15 is a two-dimensional view similar to FIG. 11, showing yet another embodiment of the grooves, which have an hour-glass figure formed at either the inner peripheral distal end of the outer shroud member or the outer peripheral distal end of the inner shroud member.

Alternative configurations of the grooves G are illustrated in FIGS. 11–15, which are merely examples of numerous possible configurations. As discussed before, the grooves G can be placed either on the outer member 110, 110' or the inner member 120, or 120' or even on both members (where alignment therebetween are possible). FIG. 11 is one example where the grooves G are formed on the outer member 110, 110'. FIG. 12 is another example of the grooves G, which are angled relative to the axial direction of the shroud 100, 100'. In FIGS. 13 and 14, the grooves G are V- or funnel-shaped to form convergent nozzles. FIG. 14 has curved configuration, whereas FIG. 13 has a linear configuration. In FIG. 15, the grooves G each form a convergent-divergent or supersonic nozzle to produce a supersonic flow. Any combination of these alternative grooves can be provided in the outer member 110, 110' or the inner member 120, 120' or in both of these members.

To help the coating material better adhere to the product, the product and the coating material can be placed at different potential levels. That is, the object to be painted can be given a negative electrostatic charge (ground) and the coating material a positive electrostatic charge. Electrostatic forces between the object and the coating material spread the coating material evenly.

A coating apparatus according to the invention thus incorporates the shroud 100, 100' described above. The coating apparatus includes the manifold 20, the turbine shaft 40, and a bell-cup atomizer 30, 30'. The air passageway 22 is adapted to communicate with an air source (not shown) and the coating material passageway 21 is adapted to communicate with a coating material source (not shown). The shaft 40 is adapted to be rotatably journalled and extends concentrically through the manifold 20. The bell-cup atomizer 30, 30' has a plurality of outlet passageways 38 that communicate with the coating material passageway 21. The inner member 120, 120' is held abuttingly against the manifold 20 and positioned substantially between the bell-cup atomizer 30, 30' and the manifold 20. The inlet passageways 129A, 129A' formed in the inner member communicate the chamber 114, 114' with the air passageway 22 in the manifold 20. The outlet passageways or nozzles 119 formed between the distal wall portions 116, 126 and 116', 126' communicate the chamber 114, 114' with the ambient. The outer member is dimensioned to permit insertion and withdrawal of the inner member together with the bell-cup atomizer in an axial direction without any interference from the bell-cup atomizer 30, 30'.

Bell-cup atomizers having differently shaped edges and configurations can be used to provide different paint coating results.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

What is claimed is:

1. A two-piece shroud for a coating apparatus, comprising:

a first piece defining an annular inner member adapted to be positioned collinearly next to an injection manifold of the coating apparatus, the inner member having a distal wall portion; and a second piece defining an annular outer member shrouded over and removably positioned over the inner member, the outer member having a distal wall portion, wherein the inner and outer members are spaced from each other to form a chamber therebetween, wherein a plurality of outlet passageways are formed between the distal wall portions of the inner and outer members wherein cross-sections of the outlet passageways become exposed when the outer member is separated from the inner member, and wherein the inner member has a wall portion having an inlet channel, a plurality of inlet passageways communicating the inlet channel with the chamber, and at least one secondary passageway communicating with the inlet channel for directing fluid to an inner periphery of the inner member.

2. A shroud for a coating apparatus, comprising:

an annular inner wall member having a first abutting portion and a first distal annular wall portion formed at a distal end of the inner member; and an annular outer wall member shrouded over the inner member and having a second abutting portion abutting the first abutting portion and a second distal annular wall portion formed at a distal end of the outer member, wherein the second distal wall portion concentrically surrounds and abuts the first distal wall portion, wherein the inner and outer members are spaced from each other to form a chamber between the abutting portions and the distal wall portions, wherein the inner member has at least one inlet passageway communicating with the chamber, wherein at least one of the first and second distal wall portions has a plurality of spaced grooves forming a plurality of outlet passageways that communicate with the chamber, wherein the inner and outer members are detachably held so that the outer member is separable from the inner member to expose the grooves, wherein the inner member has a wall portion having an inlet channel adapted to communicate with an air source, a plurality of inlet passageways communicating the inlet channel with the chamber, and a plurality of secondary inlet passageways for directing fluid to an inner periphery of the inner member.

3. A shroud according to claim 2, wherein the grooves are formed at the first distal wall portion.

4. A shroud according to claim 2, wherein the grooves are formed at the second distal wall portion.

5. A shroud according to claim 2, wherein the grooves extend to a distal terminal edge of each distal wall portion having the grooves, and the distal terminal edges of the first and second distal wall portions are substantially flush relative to each other.

6. A shroud according to claim 2, wherein the outer member is adapted to concentrically surround a manifold, which is adapted to abut against a proximal end of the inner member.

7. A shroud according to claim 2, wherein the inner member has a proximal wall portion at a proximal end thereof, the proximal wall portion being adapted to be fastened to the manifold.

8. A shroud according to claim 2, wherein the first and second abutting portions are complementary threads formed on an outer periphery of the inner member and an inner periphery of the outer member, the threads and the first and second distal wall portions holding the inner and outer members together and maintaining the inner member concentric with the outer member.

9. A shroud according to claim 2, wherein the chamber is adapted to provide a high-volume, low-pressure region.

10. A shroud for a coating apparatus, comprising:

an annular inner wall member having a first abutting portion and a first distal annular wall portion formed at a distal end of the inner member; and an annular outer wall member shrouded over the inner member and having a second abutting portion abutting the first abutting portion and a second distal annular wall portion formed at a distal end of the outer member, wherein the second distal wall portion concentrically surrounds and abuts the first distal wall portion, wherein the inner and outer members are spaced from each other to form a chamber between the abutting portions and the distal wall portions, wherein the inner member has at least one inlet passageway communicating with the chamber, wherein at least one of the first and second distal wall portions has a plurality of spaced grooves forming a plurality of outlet passageways communicating with the chamber, wherein the inner and outer members are detachably held so that the outer member is separable from the inner member to expose the grooves, and wherein the outer member has a plurality of secondary passageways extending through the outer member, which secondary passageways are adapted to bleed a portion of air to be introduced through the at least one inlet passageway.

11. A shroud according to claim 10, wherein the first and second abutting portions are complementary shoulders formed on an outer periphery of the inner member and an inner periphery of the outer member, the shoulders and the first and second distal wall portions maintaining the inner member concentric with the outer member.

12. A coating apparatus comprising:

a manifold having an air passageway adapted to communicate with an air source and a coating material passageway adapted to communicate with a coating material source;

a shaft adapted to be rotatable mounted and extending concentrically through the manifold;

a bell-cup atomizer attached to an end of the turbine shaft, the bell-cup atomizer having a plurality of outlet passageways communicating with the coating material passageway; and a shroud comprising:

an annular inner wall member having a first abutting portion and a first distal annular wall portion formed at a distal end of the inner member; and an annular outer wall member shrouded over the inner member and having a second abutting portion abutting the first abutting portion and a second distal annular wall portion formed at a distal end of the outer member, wherein the second distal wall portion concentrically surrounds and abuts the first distal wall portion, wherein the inner and outer members are spaced from each other to form a chamber between the abutting portions and the distal wall portions, wherein the inner member has at least one inlet passageway communicating the chamber with the air passageway in the manifold, wherein at least one of the first and second distal wall members has a plurality of spaced grooves that form a plurality of outlet passageways communicating the chamber with the ambient, and wherein the inner and outer members are detachably held so that the outer member is separable from the inner member to expose the grooves, wherein the inner member of the shroud is held abuttingly against the manifold and positioned substantially between the bell-cup atomizer and the manifold, wherein the inner member has a proximal wall portion at the proximal end of the inner member, the proximal wall portion being fastened to the manifold, and wherein the proximal wall portion has an inlet channel communicating with the air passageway in the manifold, a plurality of inlet passageways communicating the inlet channel with the chamber, and a plurality of secondary inlet passageways communicating the inlet channel with a second chamber defined by an inner periphery of the inner member and an outer periphery of the bell-cup atomizer.

13. A coating apparatus according to claim 12, wherein the outer member is dimensioned to permit insertion and withdrawal of the inner member together with the bell-cup atomizer in an axial direction without any interference from the bell-cup atomizer.

14. A coating apparatus according to claim 12, wherein the grooves are formed at the first distal wall portion.

15. A coating apparatus according to claim 12, wherein the grooves are formed at the second distal wall portion.

16. A coating apparatus according to claim 12, wherein the grooves extend to a distal terminal edge of their respective distal wall portion, and the distal terminal edges of the first and second distal wall portions are substantially flush.

17. A coating apparatus according to claim 12, wherein the outer wall member concentrically surrounds the manifold.

18. A coating apparatus according to claim 12, wherein the secondary passageways are for directing fluid to the inner periphery of the first distal wall portion.

19. A coating apparatus according to claim 12, wherein the first and second abutting portions are complementary threads formed on an outer periphery of the inner member and an inner periphery of the outer member, the threads and the first and second distal wall portions holding the inner and outer members together and maintaining the inner member concentric with the outer member.

20. A coating apparatus comprising:

a manifold having an air passageway adapted to communicate with an air source and a coating material passageway adapted to communicate with a coating material source;

a shaft adapted to be rotatably mounted and extending concentrically through the manifold;

a bell-cup atomizer attached to an end of the turbine shaft, the bell-cup atomizer having a plurality of outlet passageways communicating with the coating material passageway; and a shroud comprising:

an annular inner wall member having a first abutting portion and a first distal annular wall portion formed at a distal end of the inner member; and an annular outer wall member shrouded over the inner member and having a second abutting portion abutting the first abutting portion and a second distal annular wall portion formed at a distal end of the outer member, wherein the second distal wall portion concentrically surrounds and abuts the first distal wall portion, wherein the inner and outer members are spaced from each other to form a chamber between the abutting portions and the distal wall portions, wherein the inner member has at least one inlet passageway communicating the chamber with the air passageway in the manifold, wherein at least one of the first and second distal wall members has a plurality of spaced grooves that form a plurality of outlet passageways communicating the chamber with the ambient, and wherein the inner and outer members are detachably held so that the outer member is separable from the inner member to expose the grooves, wherein the inner member of the shroud is held abuttingly against the manifold and positioned substantially between the bell-cup atomizer and the manifold, and wherein the outer member has a plurality of secondary passageways extending through the outer wall member, which secondary passageways are adapted to exit a portion of air to be introduced through the at least one inlet passageway.

21. A coating apparatus according to claim 20, wherein the first and second abutting portions are complementary shoulders formed on an outer periphery of the inner member and an inner periphery of the outer member, the shoulders and the first and second distal wall portions maintaining the inner member concentric with the outer member.

* * * * *